United States Patent [19]

Kenny et al.

[11] 4,194,790

[45] Mar. 25, 1980

[54] ROCK CUTTING TIP INSERTS

[75] Inventors: Peter Kenny; Stanley N. Johnson, both of Lichfield, England

[73] Assignee: Coal Industry (Patents) Ltd., London, England

[21] Appl. No.: 564,640

[22] Filed: Apr. 2, 1975

[30] Foreign Application Priority Data

Apr. 24, 1974 [GB] United Kingdom ..... 17909/74
May 31, 1974 [GB] United Kingdom ..... 24284/74

[51] Int. Cl.[2] ..... E21C 35/18; E21B 9/36

[52] U.S. Cl. ..... 299/79; 51/309; 76/DIG. 11; 175/410; 407/118

[58] Field of Search ..... 299/79; 175/409–411; 29/196.1, 196; 51/309; 37/142 R; 76/DIG. 11; 407/118

[56] References Cited

U.S. PATENT DOCUMENTS

| | | | |
|---|---|---|---|
| 1,965,950 | 7/1934 | Walker | 299/79 X |
| 2,033,594 | 3/1936 | Stoody | 299/79 X |
| 2,201,159 | 5/1940 | Clow | 175/409 X |
| 3,010,709 | 11/1961 | Bentley et al. | 299/79 |
| 3,127,945 | 4/1964 | Bridwell et al. | 175/410 X |
| 3,260,579 | 7/1966 | Scales et al. | 29/196.1 |
| 3,368,882 | 2/1968 | Ellis et al. | 29/196 X |
| 3,790,353 | 2/1974 | Jackson | 51/309 X |
| 3,869,319 | 3/1975 | Ishihara | 29/196.1 X |
| 3,888,637 | 6/1975 | Taguchi et al. | 37/142 R X |
| 3,932,952 | 1/1976 | Helton et al. | 175/410 |

OTHER PUBLICATIONS

All Carbide Boring Bar, American Machinist, May 23, 1946, p. 115, H. E. York.

*Primary Examiner*—William F. Pate, III
*Attorney, Agent, or Firm*—James C. Wray

[57] ABSTRACT

The rock cutting tip insert of a rock cutting tool comprises two layers, the front layer being harder than the backing or base layer by at least one hundred units on the Vickers Hardness scale.

11 Claims, 3 Drawing Figures

ROCK CUTTING TIP INSERTS

This invention relates to rock cutting tip inserts.

Usually, a rock cutting tool has a recess or cut provided with a tip insert formed by cemented carbide of uniform grade, for example, the hardness of the carbide forming the tip insert is substantially constant throughout the body of the carbide. The grade of carbide is selected depending upon the rock cutting conditions encountered in any particular installation, for example, in arduous cutting conditions a relatively soft grade of carbide may be selected in order to avoid or reduce the tendency of the tip insert to fracture. However, the cutting tool may have a short operational life due to wear of the tip insert which thereby becomes blunt. Alternatively, in less arduous cutting conditions where the tendency of the tip insert to fracture is less of a problem, a harder grade of carbide may be selected in order to reduce wear of the carbide and increase the operational life of the tip insert before reshaping is required.

It will be appreciated that the requirements of the cutting or working margin of the carbide tip insert, i.e. the part of the tip insert nearest to the rock being cut, determines the grade of carbide selected for all the body of carbide.

However, irrespective of the hardness of carbide selected the tip insert will tend to wear during cutting and a wear flat or flat surface is formed on the tip insert behind the cutting or working length. The carbide wears so that the wear flat tends to be formed at an angle relative to the cutting or working margin such that a negative back clearance exists between the tip insert and the uncut rock profile. Thus the wear flat tends to rub against the uncut rock and/or particles of cut rock tend to be crushed between the wear flat and the uncut rock. Consequently, the cutting efficiency of the cutter tool is reduced and a proportionally large cutting force must be exerted on the cutter tool to cut the rock.

An object of the present invention is to provide an improved rock cutting tip insert for a rock cutting tool which tends to overcome or reduce the above mentioned problems.

According to the present invention a rock cutting tip insert comprises a cutting or working margin of one hardness level and a backing or base portion of a second hardness level, the first hardness level being at least one hundred units on the Vickers Hardness scale greater than the second hardness level.

Advantageously, the cutting or working margin and/or the backing or base portion may be formed of a hard mineral or ceramic, or of a composite material in which particles of hard mineral or ceramic are embedded in a softer matrix.

Alternatively, the cutting or working margin may be formed of the same material as the backing or base portion but subjected to a hardening process.

Advantageously, the cutting or working margin and the backing or base portion are formed of cemented carbide.

Preferably, the first hardness level is at least four hundred units on the Vickers Hardness scale greater than the second hardness level.

The present invention also provides a tip insert as defined above in combination with a rock cutting tool.

A preferred embodiment of the invention will be described with reference to the accompanying drawings in which.

Figure 1:
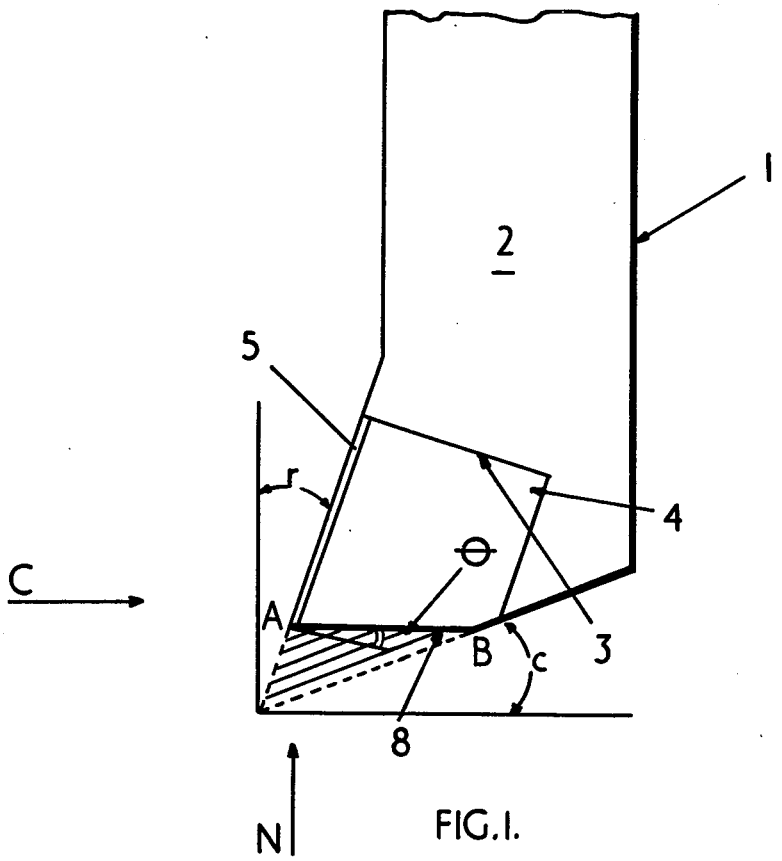
FIG. 1 is a diagrammatic side view of a part of a rock cutting tool having a cemented carbide tip insert constructed in accordance with the present invention and indicating wear of the tip insert.
Figure 2:
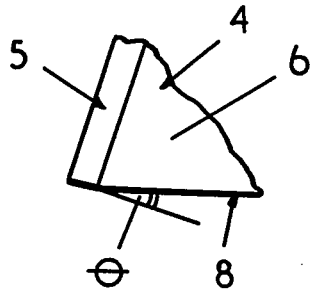
FIG. 2 shows a detail of FIG. 1 on an enlarged scale.

Referring to FIGS. 1 and 2, a rock cutter tool 1 comprises a body 2 having a recess or cutout 3 into which is mounted a tip insert 4, the tip insert being secured to the body 2 by, for example, brazing. The tip insert comprises two separate layers of cemented carbide of different hardness (see FIG. 2). The cutting or working margin 5 of a tip insert is a relatively hard grade carbide (having typically a hardness of 1450–1550 units on the Vickers Hardness scale). Typically the thickness of the cutting or working margin 5 is one millimeter.

The layer of carbide forming the cutting or working margin 5 is secured (by, for example, brazing), onto a wider backing or base portion 6 which is formed of a less hard grade carbide (having typically, a hardness of 1000–1100 units on the Vickers Hardness Scale).

FIG. 1 indicates the direction of the cutting force on the cutting tool indicated by arrow C and the front rake angle r and back clearance angle C for a sharp tip insert. In addition the direction of a force normal to the cutting force is indicated by arrow N. This force is important since it represents the direction of force acting on a wear flat or worn surface 8 which is formed in use. The wear flat is shown in detail in FIG. 2 and can be seen to lie in one plane in the hard cutting or working margin 5 and in another plane in the less hard backing or base portion 6. The angle between the two planes as indicated in FIG. 1 is called the wear angle. The so called wear angle is formed because the less hard grade of carbide forming the backing or base portion 6 is more readily worn away than the hard grade of carbide forming the cutting or working margin. Thus, during cutting as the pick wears and the wear flat is formed the cutting or working margin of the tip insert tends to cut clearance for the backing or base portion. Thereby the effect of rubbing the rock left uncut by the cutter tool is reduced.

In addition, as the moving tip insert presents a progressively increasing gap between a point on the uncut rock and the tip insert, particles of cut rock tend not to be crushed between the tip insert and the uncut rock.

Consequently, the cutting force and the force in the direction normal to the cutting force are reduced. Thereby, the force exerted on the cutting tool during cutting is reduced and a more efficient cutting action is obtained throughout an extended operational life of the cutting tool.

Figure 3:
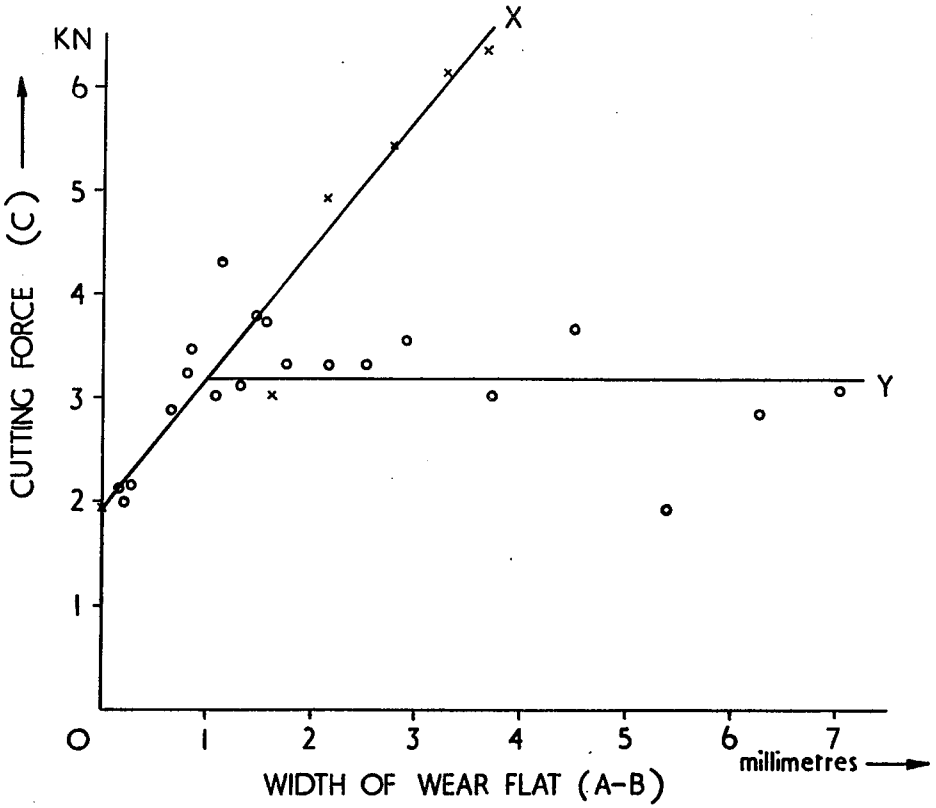
FIG. 3 shows two graphs comprising the cutting force exerted on a cutter tool against the wear on the cutter tool for a prior known cutter tool and for a tool constructed in accordance with the present invention.

FIG. 3 shows two graphs illustrating force on the tool during cutting against the width of the wear flat, i.e. the distance A–B in FIG. 1. Graph X is for a cutter tool having a prior known tip insert consisting of a single uniform grade of carbide. Graph Y is for a cutter tool constructed in accordance with the present invention and having a tip insert comprising two layers of differing grade of carbide as previously described with reference to FIGS. 1 and 2.

As will be seen for a width of wear flat up to one millimeter the two graphs X and Y follow the same path. This is because the hard cutting or working margin 5 of the tip insert is one millimeter wide.

However, once the wear-flat extends beyond a width of one millimeter the two graphs X and Y differ. Graph X shows that for the cutter tool with prior known tip insert the force exerted on the cutter tool increases sharply at a constant rate as the width of the wear flat increases. Thus, in use as the tip insert wears the cutting efficiency falls rapidly.

Graph Y shows that for the cutter tool having a tip insert constructed in accordance with the present invention the force exerted on the cutter tool remains constant at a relatively low value. The force N acting in the direction normal to the cutting force is affected in similar manner to that previously described with reference to the cutting force C. Thus, the cutting efficiency of the cutter tool remains relatively high throughout the extended operational life of the cutter tool.

In modifications of the invention the tip insert comprises two grades of carbides having a hardness difference of over one hundred units on the Vickers Hardness scale.

In further modifications of the invention, the cutting or working margin and/or the back or base portion may be formed of a hard mineral or ceramic, or of a composite material in which particles of hard mineral or ceramic are embedded in a softer matrix. The mineral may be, for example, powdered diamond material.

Alternatively, the cutting or working margin may be formed of the same material as the backing or base portion but subjected to a hardening process. Such a process may involve mechanical, thermal, chemical or radiation treatment. The cutting or working margin may, after treatment, be secured to the backing or base portion, or may be formed by treatment of the appropriate region of the rock cutting tip constructed initially of the material for the backing or base portion.

We claim:

1. A rock cutting tip insert for placing in a recess of a rock cutting tool, the tip insert comprising two separate continuous layers of similar composite material having different hardness, a first layer being a cutting margin of one hardness level and the second layer being a backing portion of material similar to the first layer having a second hardness level, of at least one thousand units on the Vickers Hardness scale, said first hardness level being at least one hundred units on the Vickers Hardness scale greater than said second hardness level, the first layer cutting margin being secured to the second layer backing portion, and the second layer backing portion being secured to the tool.

2. A rock cutting tip insert as claimed in claim 1, in which the cutting margin is formed of the same material as the backing portion but subjected to a hardening process.

3. A rock cutting tip as claimed in claim 1, in which, said first hardness level is at least four hundred units on the Vickers Hardness scale greater than said second hardness level.

4. A rock cutting tool including a body and a rock cutting tip insert carried by the body and comprising a tool body having a recess for receiving a rock cutting tip, the tip having first and second continuous layers of similar composite material having different hardness, the first layer comprising a cutting margin of one hardness level and the second layer comprising a backing portion of a second hardness level, and means for securing the second layer backing portion to the tool body, said first hardness level being at least one hundred units on the Vickers Hardness scale greater than said second hardness level.

5. A rock cutting tool as claimed in claim 4, in which said first hardness level is at least four hundred units on the Vickers Hardness scale greater than said second hardness level.

6. The rock cutting tool as claimed in claim 4 wherein the backing portion is harder than the tool body.

7. The rock cutting tip insert as claimed in claim 1 wherein the cutting margin and the backing portion consist of a material selected from the group of materials consisting of a hard mineral, ceramic or composite material.

8. The rock cutting tip insert as claimed in claim 1, wherein the cutting margin and backing portion comprise cemented carbide.

9. The rock cutting tip insert as claimed in claim 1 further comprising a rock cutting tool and mounting means for securing the backing portion on the rock cutting tool.

10. The rock cutting tip as claimed in claim 1 wherein the tool has a recess and the mounting means comprises means for securing the backing portion on the cutting tool within the recess.

11. The rock cutting tip insert as claimed in claim 1 wherein the cutting margin is approximately 1 mm. in thickness.

* * * * *